US006065696A

United States Patent [19]

Tsai

[11] Patent Number: 6,065,696

[45] Date of Patent: May 23, 2000

[54] DUAL FUNCTION PAPER SHREDDER

[76] Inventor: Jeff Tsai, No. 17, Lane 267, Hua-Cheng Rd., Chuang City, Taipei Hsien, Taiwan

[21] Appl. No.: 09/320,948

[22] Filed: May 26, 1999

[30] Foreign Application Priority Data

Dec. 31, 1998 [TW] Taiwan ..... 87222093

[51] Int. Cl.[7] ..... B02C 18/22

[52] U.S. Cl. ..... 241/37.5; 241/186.1; 241/236; 241/285.3

[58] Field of Search ..... 241/37.5, 134, 241/141, 186.1, 186.3, 236, 285.2, 285.3

[56] References Cited

U.S. PATENT DOCUMENTS 4,192,467 3/1980 Hatanaka ..... 241/34
4,241,881 12/1980 Laumer ..... 241/28
4,564,146 1/1986 Bleasdale ..... 241/236
4,821,967 4/1989 Moriyama ..... 241/37.5
5,188,301 2/1993 Hasegawa ..... 241/33
5,560,553 10/1996 Crane ..... 241/186.1
5,915,636 6/1999 Caballero ..... 241/73

*Primary Examiner*—John M. Husar
*Attorney, Agent, or Firm*—Smith, Gambrell & Russell, LLP

[57] ABSTRACT

A dual function paper shredder includes a housing having first and second paper inlets, and an interior chamber. A strip forming cutter and a shredding cutter are received inside the chamber and are adapted for cutting paper sheets. The strip forming cutter and the shredding cutter are driven by a driving unit which includes a motor and a gear mechanism. A safety cover is pivotally mounted on the housing for turning between a first position for covering one of the first and second paper inlets, and a second position for covering the other one of the first and second paper inlets.

4 Claims, 5 Drawing Sheets

(B-B)

(A-A)

DUAL FUNCTION PAPER SHREDDER

BACKGROUND OF THE INVENTION

1. Field of the Invention

This invention relates to a paper shredder, more particularly to a dual function paper shredder that is capable of cutting paper sheets into narrow strips or into small shreds.

2. Description of the Related Art

Conventionally, shredding devices normally provide a single cutting mode in which paper sheets are cut into narrow strips or into small shreds. The shredding devices that cut the paper sheets into narrow strips are herein referred as strip forming cutters, while those that cut the paper sheets into small shreds are referred as shredding cutters. As the strip cutting is simple and the force borne by the strip cutter is less, a larger number of paper sheets can be fragmented in one time by a strip forming cutter than that by a shredding cutter. Although it is more advantageous to use strip forming cutter than the shredding cutter when energy consumption is a major consideration, the strip forming cutter is insufficient to disintegrate confidential documents. It would be uneconomical for the consumer to purchase two kinds of shredding devices to cut non-confidential documents and shred confidential documents. Therefore, it is desirable to provide a shredding device that is capable of cutting paper sheets into shreds or into narrow strips as desired.

SUMMARY OF THE INVENTION

Therefore, it is an object of the present invention to provide a dual function paper shredder that is capable of cutting paper into narrow strips as well as small shreds as desired.

Accordingly, a dual function paper shredder comprises: a housing having a top, two opposite first and second paper inlets disposed on the top, and an interior chamber; a strip forming cutter adapted for cutting paper sheets into narrow strips, the strip forming cutter being disposed inside the chamber below the first paper inlet and being adapted to cut a piece of paper fed through the first paper inlet; a shredding cutter adapted for cutting paper sheets into shreds, the shredding cutter being disposed below the second paper inlet and being adapted to cut a piece of paper fed through the second paper inlet; a motor mounted inside the chamber and connected to the strip forming cutter and the shredding cutter; and a safety cover pivotally mounted on the top for turning about an axis between a first position for covering one of the first and second paper inlets, and a second position for covering the other one of the first and second paper inlets.

BRIEF DESCRIPTION OF THE DRAWINGS

In drawings which illustrate an embodiment of the invention.

DETAILED DESCRIPTION OF THE PREFERRED EMBODIMENT

Figure 1:
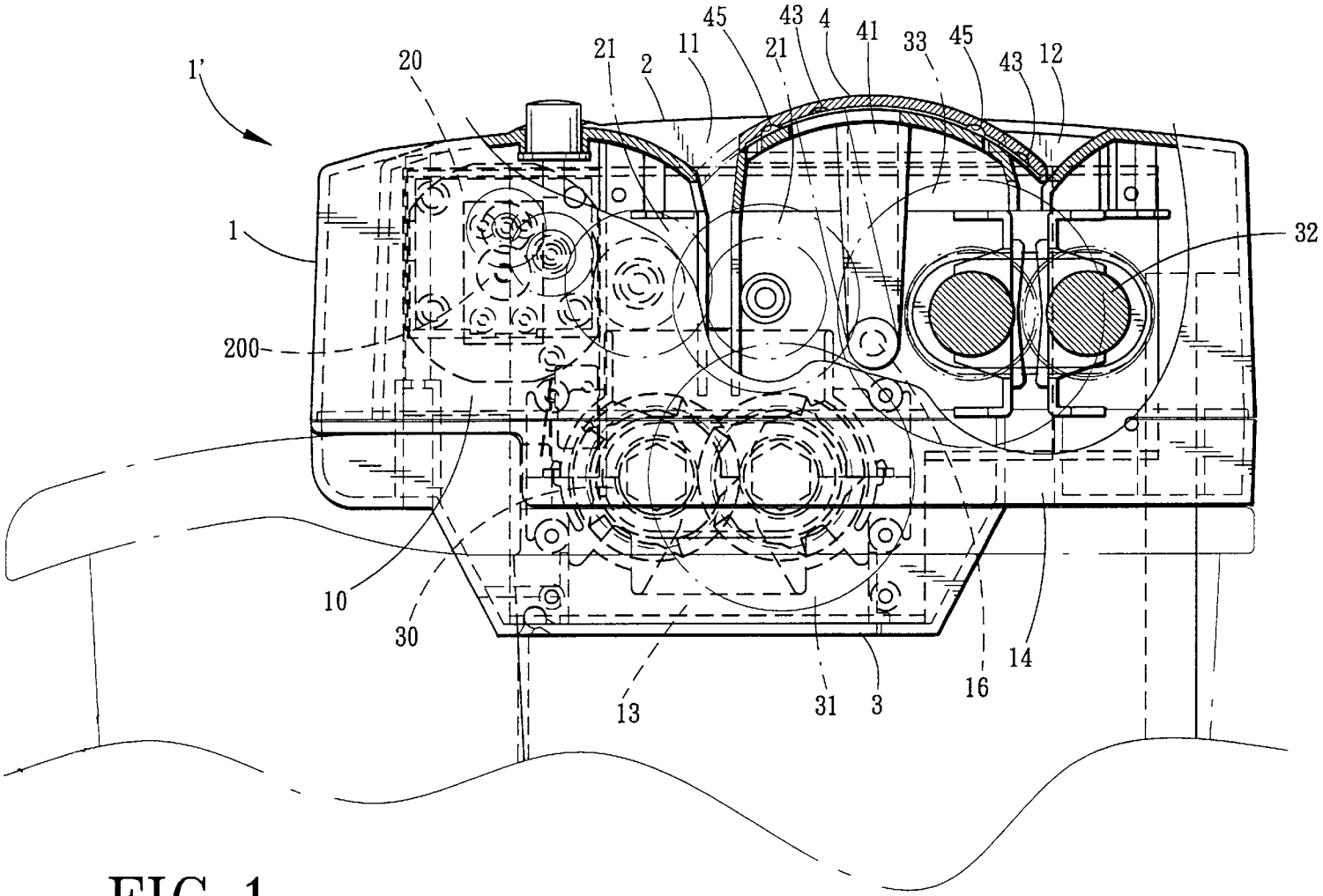
FIG. 1 is a side view of a dual function paper shredder embodying this invention.
Figure 2:
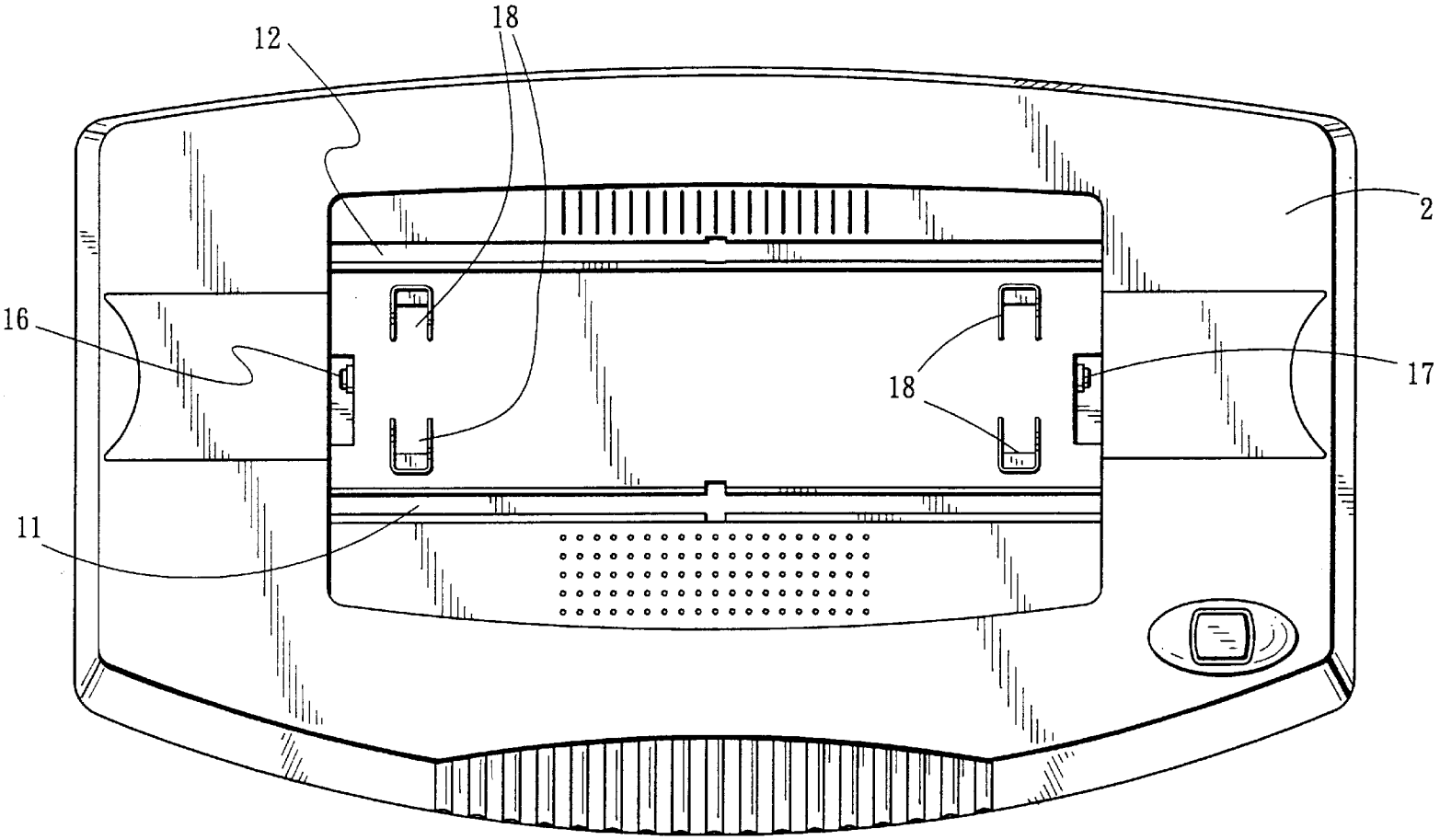
FIG. 2 is a top view of the dual function paper shredder of FIG. 1 with a cover thereof removed therefrom.

FIGS. 1 and 2 illustrate a dual function paper shredder 1' embodying this invention. The shredder 1' includes a housing 1 having a top 2, a bottom 3, two opposite first and second paper inlets 11, 12 disposed on the top 2, two opposite first and second paper outlets 13, 14 disposed at the bottom 3, and an interior chamber 10.

A strip forming cutter 30 is adapted for cutting paper sheets into narrow strips and is disposed inside the chamber 10 below the first paper inlet 11. A shredding cutter 32 is adapted for cutting paper sheets into shreds and is disposed inside the chamber 10 below the second paper inlet 12. The strip forming cutter 30 and the shredding cutter 32 are synchronously driven by a driving means so as to cut the paper sheets fed through the first or the second paper inlet 11, 12. The driving means described above is also disposed inside the chamber 10, and includes a motor 20 with a shaft 200, a gear mechanism 21 connected to the shaft 200 of the motor 20, and first and second transmission units 31, 33 which are connected the gear mechanism 21 and which are further connected to the strip forming cutter 30 and the shredding cutter 32, respectively. With such an arrangement, the dual function paper shredder 1' is capable of cutting the paper sheets into narrow strips or into small shreds as desired. The configurations and structures of the strip forming cutter 30 and the shredding cutter 32 per se are known in the art, and thus, will not be detailed herein.

Figure 3:
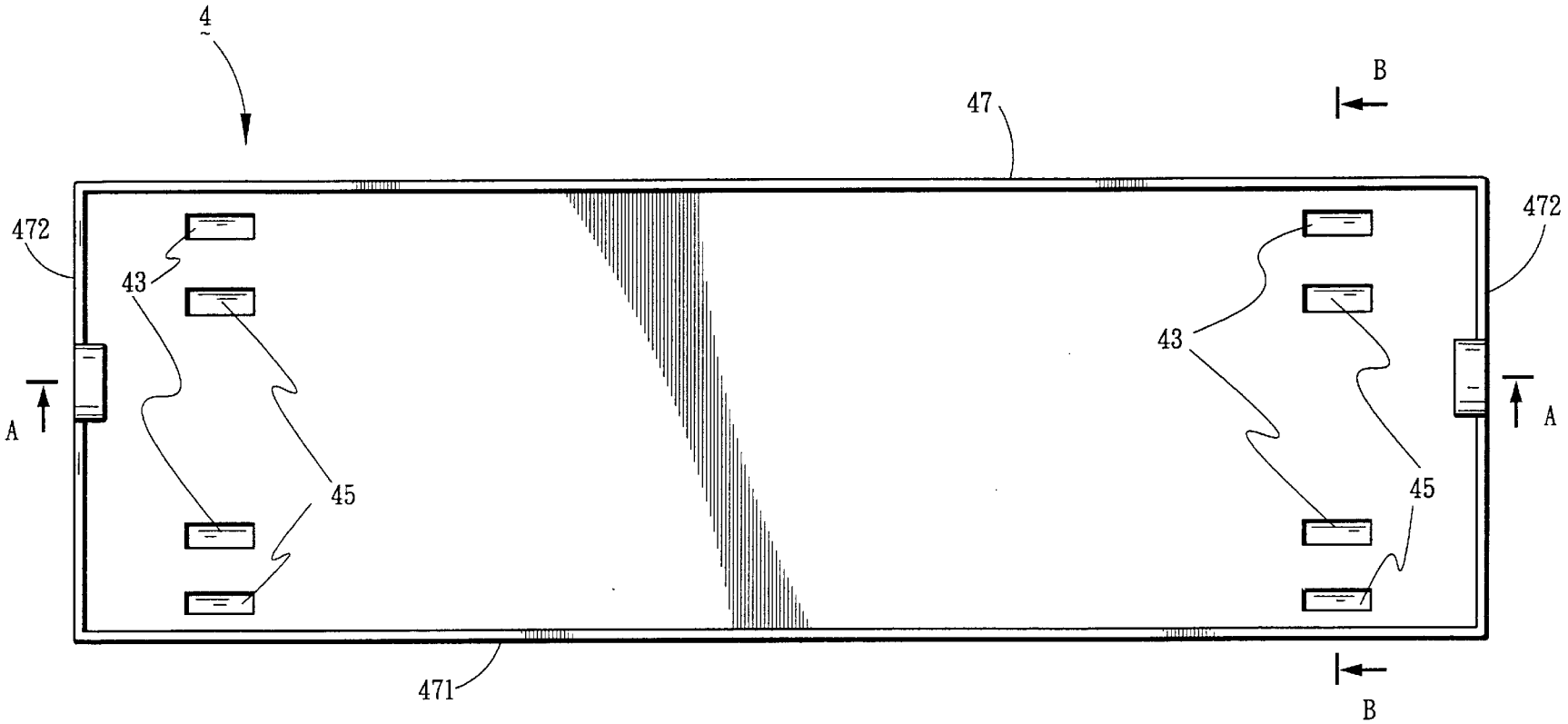
FIG. 3 is a top view of a safety cover of the dual function paper shredder of FIG. 1.
Figure 4:
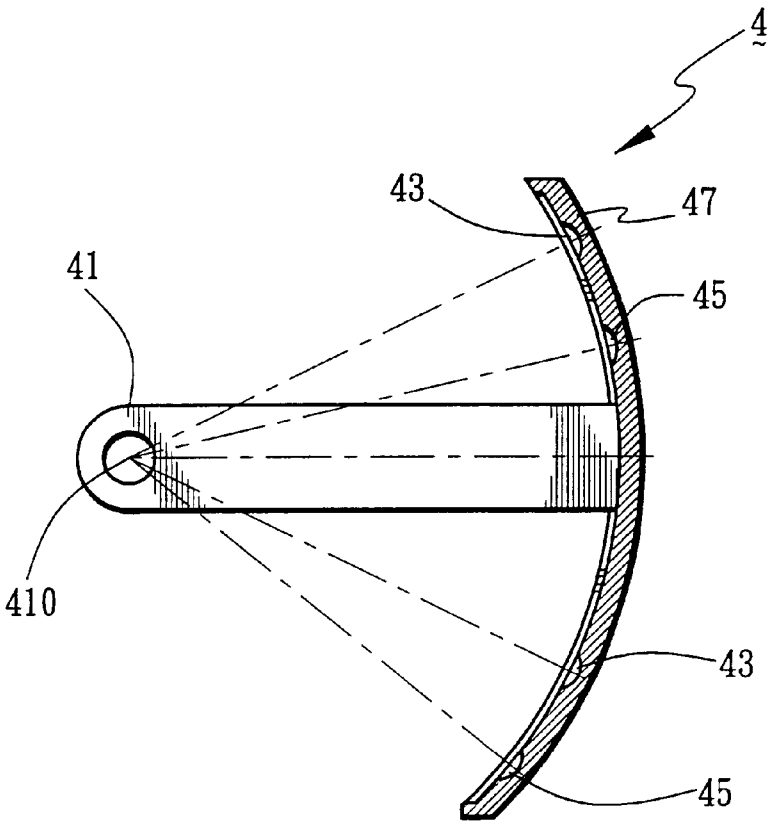
FIG. 4 is a cross-sectional side view of the safety cover taken along line B—B of FIG. 3.
Figure 5:
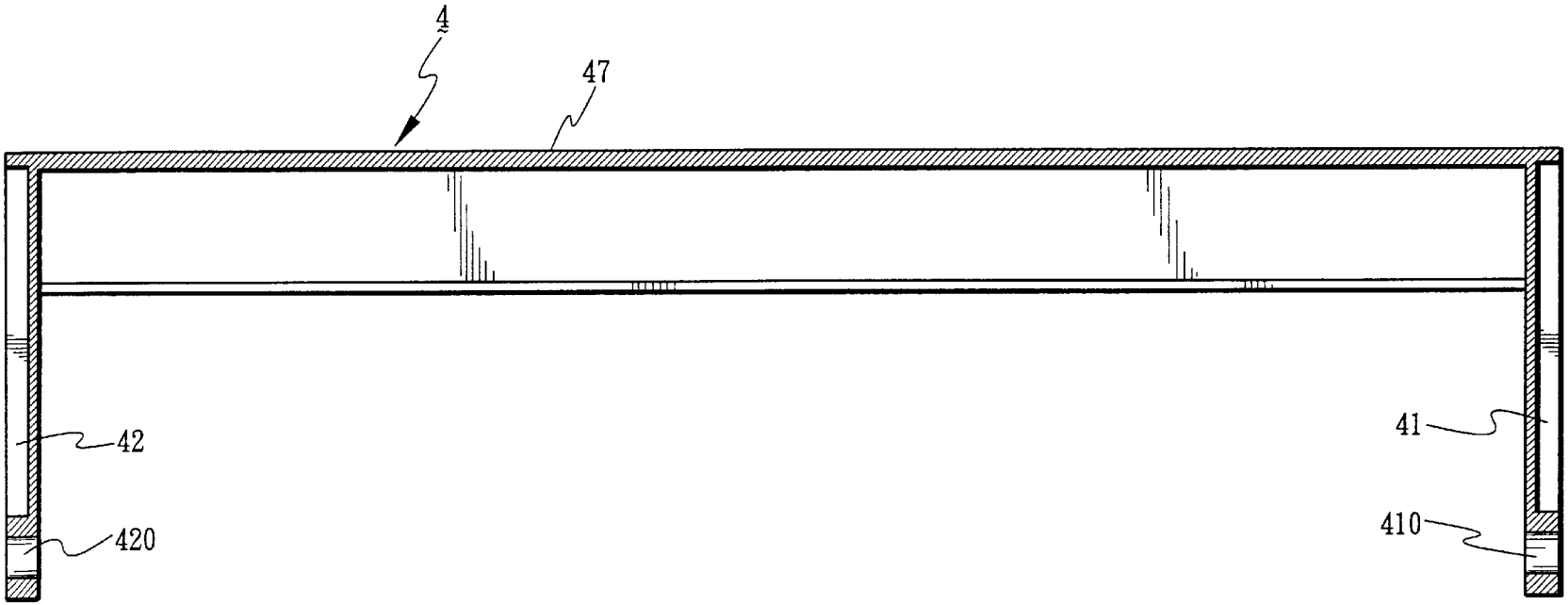
FIG. 5 is a cross-sectional side view of the safety cover taken along line A—A of FIG. 3.

Referring now to FIGS. 3 to 5 in combination with FIGS. 1 and 2, the shredder 1' further includes a safety cover 4 pivotally mounted on the top 2 of the housing 1 for turning between a first position for covering the first paper inlet 11, and a second position for covering the second paper inlet 12 (as shown in dotted lines in FIG. 1). The safety cover 4 includes a curved plate 47 having two opposite axial ends 471 and two opposite circumferential ends 472 interconnecting the axial ends 471. A pair of opposite arms 41, 42 extend downward from the circumferential ends 472, and are pivotally connected to the housing 1 via a pair of juts 16, 17 (see FIGS. 1 and 2) which are mounted on the housing 1, and which extend through through-holes 410, 420 in the arms 41, 42. As such, the curved plate 47 can be turned about the juts 16, 17 as a turning axis. As shown in FIGS. 2 and 3 the safety cover 4 further includes a plurality of first and second locking recesses 43, 45 formed the plate 47, and the top 2 of the housing 1 is provided with a plurality of locking protrusions 18. The first locking recesses 43 engage the locking protrusions 18 when the safety cover 4 is in the first position, and the second locking recesses 45 engage the locking protrusions 18 when the safety cover 4 is in the second position.

With the invention thus explained, it is apparent that various modifications and variations can be made without departing from the spirit of the present invention. It is therefore intended that the invention be limited only as recited in the appended claims.

I claim:

1. A dual function paper shredder, comprising:

a housing having a top, two opposite first and second paper inlets disposed on said top, and an interior chamber;

a strip forming cutter adapted for cutting paper sheets into narrow strips, said strip forming cutter being disposed inside said chamber below said first paper inlet and being adapted to cut a piece of paper fed through said first paper inlet;

a shredding cutter adapted for cutting paper sheets into shreds, said shredding cutter being disposed below said second paper inlet and being adapted to cut a piece of paper fed through said second paper inlet;

a motor mounted inside said chamber and connected to said strip forming cutter and said shredding cutter; and a safety cover pivotally mounted on said top for turning about an axis between a first position for covering one of said first and second paper inlets, and a second position for covering the other one of said first and second paper inlets.

2. The dual function paper shredder as claimed in claim 1, wherein said safety cover includes a curved plate having two opposite axial ends extending axially of said axis of the turning of said cover, two circumferential ends extending circumferentially of said axis and interconnecting said axial ends, and a pair of opposite arms extending downward from said circumferential ends and pivotally connected to said housing.

3. The dual function paper shredder as claimed in claim 2, wherein said housing further includes a plurality of locking protrusions projecting upward from said top of said housing between said first and second paper inlets, said safety cover further including a plurality of first and second locking recesses formed in said plate of said safety cover, said first locking recesses engaging said locking protrusions when said safety cover is in said first position, said second locking recesses engaging said locking protrusions when said safety cover is in said second position.

4. The dual function paper shredder as claimed in claim 2, further comprising a gear mechanism mounted inside said chamber and connected to said motor, said strip forming cutter, and said shredding cutter.

* * * * *